US007059873B2

(12) United States Patent
Johnescu et al.

(10) Patent No.: US 7,059,873 B2
(45) Date of Patent: Jun. 13, 2006

(54) LGA-BGA CONNECTOR HOUSING AND CONTACTS

(75) Inventors: Douglas M. Johnescu, York, PA (US); Stuart C. Stoner, Lewisberry, PA (US); Christopher Daily, Harrisburg, PA (US); Christopher J. Kolivoski, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/997,102

(22) Filed: Nov. 24, 2004

(65) Prior Publication Data

US 2005/0124189 A1 Jun. 9, 2005

Related U.S. Application Data

(60) Provisional application No. 60/528,103, filed on Dec. 9, 2003, provisional application No. 60/528,222, filed on Dec. 9, 2003.

(51) Int. Cl.
*H01R 12/00* (2006.01)
*H01R 13/40* (2006.01)

(52) U.S. Cl. ..... 439/83; 439/444; 439/943

(58) Field of Classification Search ..... 439/66, 439/71, 83, 342, 733.1, 444, 943
See application file for complete search history.

(56) References Cited

U.S. PATENT DOCUMENTS 3,912,354 A * 10/1975 Campbell et al. ..... 439/404
4,060,296 A * 11/1977 Kunkle et al. ..... 439/70
4,260,212 A * 4/1981 Ritchie et al. ..... 439/395
4,621,880 A * 11/1986 Rush ..... 439/83
4,682,829 A * 7/1987 Kunkle et al. ..... 439/83
4,767,342 A * 8/1988 Sato ..... 439/78
5,286,218 A * 2/1994 Sakurai et al. ..... 439/444
5,522,133 A * 6/1996 Kawauchi ..... 29/874
5,746,608 A * 5/1998 Taylor ..... 439/70
5,910,031 A * 6/1999 Goto ..... 439/752.5
6,024,584 A * 2/2000 Lemke et al. ..... 439/83
6,099,326 A * 8/2000 Lin ..... 439/83
6,132,222 A 10/2000 Wang et al.
6,186,797 B1 * 2/2001 Wang et al. ..... 439/66
6,241,535 B1 * 6/2001 Lemke et al. ..... 439/83
6,247,954 B1 * 6/2001 Ju ..... 439/342
6,261,132 B1 * 7/2001 Koseki et al. ..... 439/733.1
6,471,535 B1 * 10/2002 Walkup et al. ..... 439/342
6,482,050 B1 * 11/2002 Lemke et al. ..... 439/856
6,488,513 B1 12/2002 Neidich et al. ..... 439/66

(Continued)

*Primary Examiner*—Neil Abrams
(74) *Attorney, Agent, or Firm*—Woodcock Washburn LLP

(57) ABSTRACT

Electrical connectors and contacts are disclosed. An electrical connector having a contact receiving well extending along a contact receiving direction, and having a generally T-shaped cross-section along a direction transverse to the contact receiving direction. An electrical contact may be received in the contact receiving well. The contact may include a generally planar body portion, a groove and shoulder for use with a pressing tool, a first contact portion extending from a first end of the body portion, and a second contact portion extending from a second end of the body portion. The contact is adapted to be received into a generally T-shaped contact receiving well to prevent movement of the electrical contact therein. The electrical contact includes burrs formed by stamping to cut into the receiving well, and a contact tail with double bend, allowing the tail to float within a cavity of the contact receiving well.

19 Claims, 6 Drawing Sheets

U.S. PATENT DOCUMENTS 6,561,817 B1 * 5/2003 Ma ..... 439/66
6,572,386 B1 * 6/2003 Howell et al. ..... 439/66
6,585,527 B1 * 7/2003 Koopman et al. ..... 439/71
6,733,320 B1 * 5/2004 Kukita et al. ..... 439/342
6,764,313 B1 7/2004 Hougham ..... 439/65
6,905,377 B1 * 6/2005 Murr ..... 439/862

* cited by examiner

LGA-BGA CONNECTOR HOUSING AND CONTACTS

CROSS-REFERENCE TO RELATED APPLICATIONS

This application claims benefit under 35 U.S.C. § 119(e) of provisional U.S. patent application No. 60/528,103, filed Dec. 9, 2003, entitled "Methods For Controlling Contact Height," and of provisional U.S. patent application No. 60/528,222, filed Dec. 9, 2003, entitled "LGA-BGA Connector Housing And Contacts."

The subject matter disclosed and claimed herein is related to the subject matter disclosed and claimed in U.S. patent application Ser. No. 10/997,129, filed on even date herewith, entitled "Methods for Controlling Contact Height."

The disclosure of each of the above-referenced patent applications is incorporated herein by reference in its entirety.

FIELD OF THE INVENTION

The invention relates generally to electrical connectors. More specifically, the invention relates to improved housing and contact designs that are suitable for LGA-BGA connectors.

BACKGROUND OF THE INVENTION

Land grid array (LGA) connectors and connectors utilizing ball grid arrays (BGA) for attachment to circuit substrates are known. An LGA-to-BGA connector typically includes one or more electrical contacts, each having a BGA end and an LGA end. The contacts typically extend through a connector housing.

One of the problems with manufacturing BGA connectors, however, is that the contacts tend to twist and rotate during insertion of the contacts into the housing. Another known problem is that, even after insertion, the contacts are not "locked" into the housing. For example, when connectors are reflowed to a printed circuit board (PCB), they are typically exposed to temperatures that may be at or above the glass transition temperature of the material of which the housing is made. The resultant stress relaxation of the plastic can be such that the contacts may move from their true positioning.

In the design of an LGA-to-BGA contact, it is desirable to stabilize the LGA contact to the housing so that movement of the BGA end does not influence contact deflection and normal force that would adversely affect low-level contact resistance (LLCR). However, where the contact is rigidly attached to the housing, normal coefficient of thermal expansion (CTE) mismatch and/or housing/PCB bow can lead to high solder strain and early solder joint failure. Thus, to minimize solder strain, it is also desirable to provide compliancy below the contact retention area.

SUMMARY OF THE INVENTION

An electrical connector according to the invention may include a housing that defines a contact receiving well. An electrical contact may be received in the contact receiving well such that the contact receiving well prevents movement of the electrical contact within the contact receiving well.

The contact receiving well may be defined by a rear wall, a pair of front walls, and a pair of side walls. The contact may include a generally planar body portion that may be contained by any or all of the walls that define the contact receiving well. The contact receiving well may also include an internal surface that contains the contact in the direction in which the contact is received into the well. The body portion of the contact may have a sharp edge, or burr, that may be used to engage one of the well walls.

The contact may include a ball end, and the contact receiving well may have a ball/contact cavity through which the contact extends. The cavity may be configured to limit movement of the ball end into the contact receiving well. The ball end of the contact may have a diameter that is greater than the width of the opening of the cavity. The contact may include a double bend portion that enables a tail portion of the contact to float in the ball/contact cavity.

The body portion of the contact may include an alignment slot extending into the body portion from a first end thereof. The contact may also include a push shoulder extending from the body portion. The push shoulder may have a push surface for seating the contact into the connector housing.

A first contact portion, which may be an LGA contact portion, may extend from one end of the body portion. A second contact portion, which may be a BGA contact portion, may extend from the other end of the body portion. The body portion may be configured to permit adjustment of an offset between the first contact portion and the second contact portion.

A method for manufacturing an electrical connector according to the invention includes inserting a contact into a contact receiving well of a connector housing, the contact having a tail end that extends toward a mounting interface of the connector. A solder ball may be attached to the tail end of the contact. The housing may include a cavity having an opening for receiving the contact tail end, a solder ball, and, if desirable, solder paste deposited into the cavity. The solder ball may be pressed into the solder paste against the opening of the cavity. To prevent the contact from being pulled into the housing through the opening, the diameter of the solder ball is greater than the width of the well opening. The solder may then be heated to a temperature that is greater than the solder's liquidous temperature. The solder is allowed to cool, thereby bonding the solder ball to the contact.

DETAILED DESCRIPTION OF ILLUSTRATIVE EMBODIMENTS

Generally, an electrical contact according to the invention may include a body portion having an LGA end and a BGA end. An LGA contact portion extends from the LGA end of the body portion. A BGA contact portion extends from the BGA end of the body portion. The contact may include a contact alignment slot that extends into the body portion. The contact alignment slot may be used to locate, trap, and push the contact into the housing. This tends to reduce or eliminate twisting and rotation of the contact during insertion of the contact into the housing. The contact may also include a push shoulder that extends from an end of the body portion. Preferably, the push shoulder has a push surface that can be used for seating the contact in the housing.

According to the invention, the contact is designed to permit easy adjustment of LGA contact to BGA tail offset, without changing the LGA contact or assembly features. For example, the BGA contact attachment point can be anywhere along the BGA end of the body portion of the contact. Additionally, the BGA tail could be in line with the plane defined by the body portion of the contact, or extend any distance away from plane defined by the body portion, depending upon how much offset is desired.

Figure 1B:
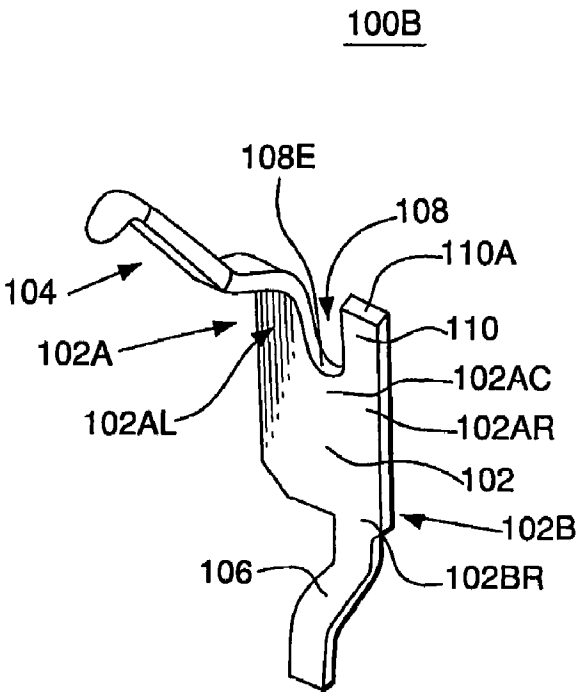
FIGS. 1A–1D depict example embodiments of LGA-to-BGA contacts according to the invention.
Figure 1A:
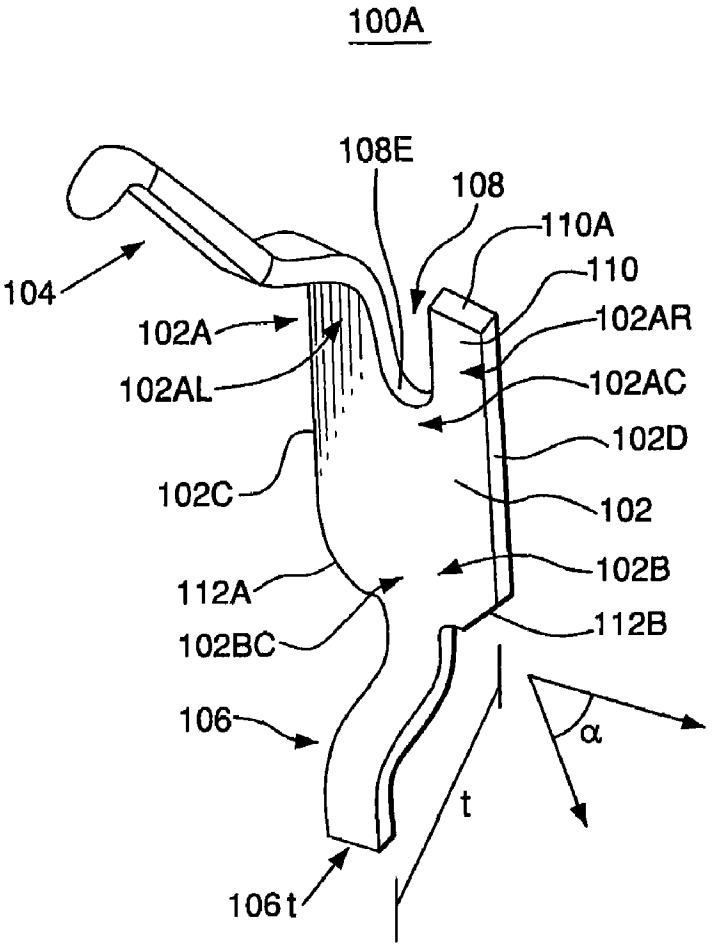

FIGS. 1A–1D depict example embodiments of LGA-to-BGA contacts according to the invention. As shown in FIG. 1A, the electrical contact 100A includes a body portion 102 having an LGA end 102A, a BGA end 102B, which is opposite the LGA end 102A, and side edges 102C, 102D. Preferably, the body portion is generally planar and, therefore, defines a plane. The BGA end 102B of the body portion 102 may include a respective shoulder 112A, 112B at the BGA end of each side edge 102C, 102D.

An LGA contact portion 104 may extend from a side portion 102AL of the first end 102A of the body portion 102. A BGA contact portion 106 may extend from a central portion 102BC of the second end 102B of the body portion 102. The BGA contact portion 106 may have a tail offset t. That is, the tail end 106*t* of the BGA contact portion 102 may extend away from the plane of the body portion 102 by a distance t. The BGA contact portion 106 may be disposed at an angle a to the plane defined by the body portion 102. As shown, the BGA contact portion 106 may be at an angle $\alpha$ of about 90° to the plane defined by the body portion 102. It should be understood, however, that the angle $\alpha$ may be any angle from 0 to 360°.

The contact 100A may include a slot 108 that extends into the body portion 102 from the first end 102A. The slot 108 is preferably a die cut feature, and may be used to locate, trap, and push the contact into the housing. As shown, the slot 108 may extend into a central portion 102AC of the first end 102A of the body portion 102. The end 108E of the slot 108 may also provide a convenient reference for setting contact dimensions and the like. That is, various contact dimensions may be defined relative to the location of the end 108E of the slot 108.

The electrical contact 100A may also include a push shoulder 110 extending from the body portion 102. As shown, the push shoulder 110 may extend from a side portion 102AR of the first end 102A of the body portion 102, and have a push surface 110A for seating the contact 100A. The push shoulder 110 may be, but is not limited to being, formed by the final assembly machine that cuts the contact off of the carrier strip. The push shoulder 110 may also provide manufacturing with a flat surface that can be easily used in conjunction with the slot 108 to locate the contacts in the housing or as a push surface to finally seat the contacts, if a final setting operation is necessary.

As shown in FIG. 1B, the electrical contact 100B includes a body portion 102 having a first end 102A and a second end 102B. An LGA contact portion 104 extends from a side portion 102AL of the first end 102A of the body portion 102. A slot 108 extends into the body portion 102 from a central portion 102AC of the first end 102A of the body portion 102. A push shoulder 110 extends from a side portion 102AR of the first end 102A of the body portion 102, and has a push surface 110A for seating the contact 100B as described above.

In contrast with the contact 100A depicted in FIG. 1A, the BGA contact portion 106 of the contact 100B may extend from a side portion 102BR, rather than from a center portion 102BC, of the second end 102B of the body portion 102. Thus, it should be understood that the BGA contact portion 106 could extend from any of a number of attachment points (e.g., 102BC, 102BR) along the edge of the BGA end 102B of the body portion 102, and that the particular attachment point for any contact may be chosen as suitable for a particular connector application.

Figure 1D:
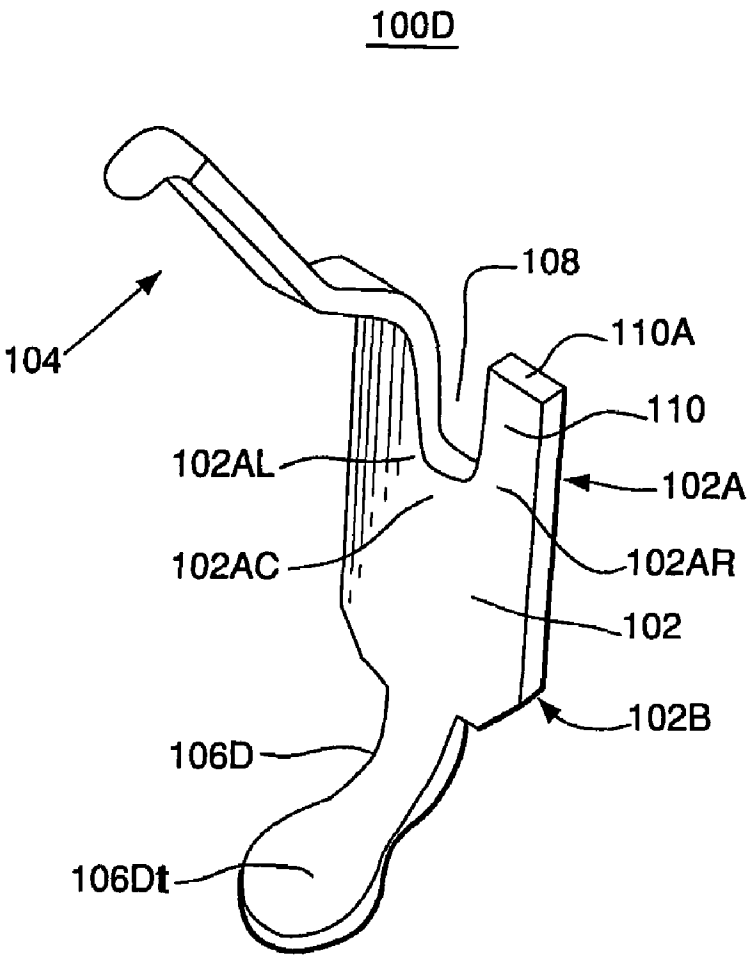
Figure 1C:
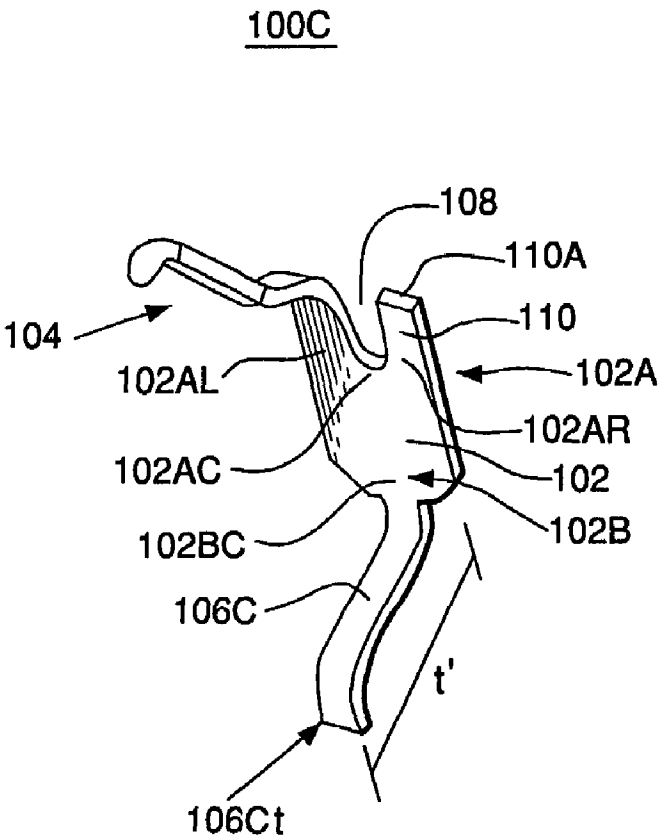

As shown in FIG. 1C, the electrical contact 100C includes a body portion 102 having a first end 102A and a second end 102B. An LGA contact portion 104 extends from a side portion 102AL of the first end 102A of the body portion 102. A BGA contact portion 106C extends from a central portion 102BC of the second end 102B of the body portion 102. A slot 108 extends into the body portion 102 from a central portion 102AC of the first end 102A of the body portion 102. A push shoulder 110 extends from a side portion 102AR of the first end 102A of the body portion 102, and has a push surface 110A for seating the contact 100C as described above.

The BGA contact portion 106C of the contact 100C may have a tail offset t' that differs from the tail offset t of the contact 100A. Though the tail offset t' is depicted in FIG. 1C as being greater than the tail offset t depicted in FIG. 1A, it should be understood that, in accordance with the invention, the BGA tail offset could be any distance, even negative. That is, the tail 106Ct could be "behind" the body portion 102 of the contact 100C (i.e., into the page of FIG. 1C).

FIG. 1D depicts an electrical contact 100D that includes a body portion 102 having a first end 102A and a second end 102B. An LGA contact portion 104 may extend from a side portion 102AL of the first end 102A of the body portion 102. A slot 108 may extend into the body portion 102 from a central portion 102AC of the first end 102A of the body portion 102. A push shoulder 110 may extend from a side portion 102AR of the first end 102A of the body portion 102, and have a push surface 110A for seating the contact 100D.

In contrast with the contact 100A depicted in FIG. 1A, the BGA contact portion 106D of the contact 100D is a compliance feature having a tail end 106Dt in the configuration of a solder ball paddle, rather than in a post solder configuration. The solder ball paddle 106Dt could be generally flat and solid, as depicted in FIG. 1D, or it could be dimpled, cupped, hollowed, etc., to help locate the solder ball on the paddle.

Figure 2B:
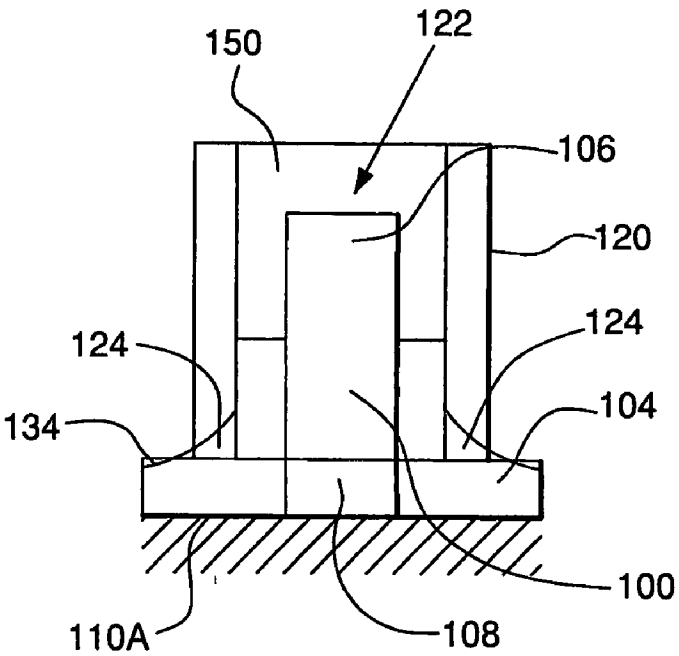
FIGS. 2A–2D depict an example embodiment of a contact receiving well defined by a connector housing.
Figure 2A:
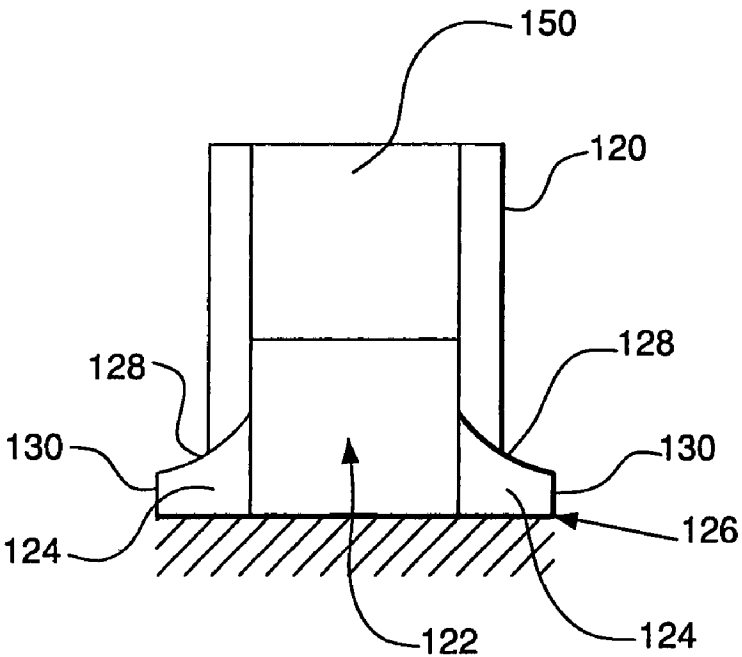
Figure 2C:
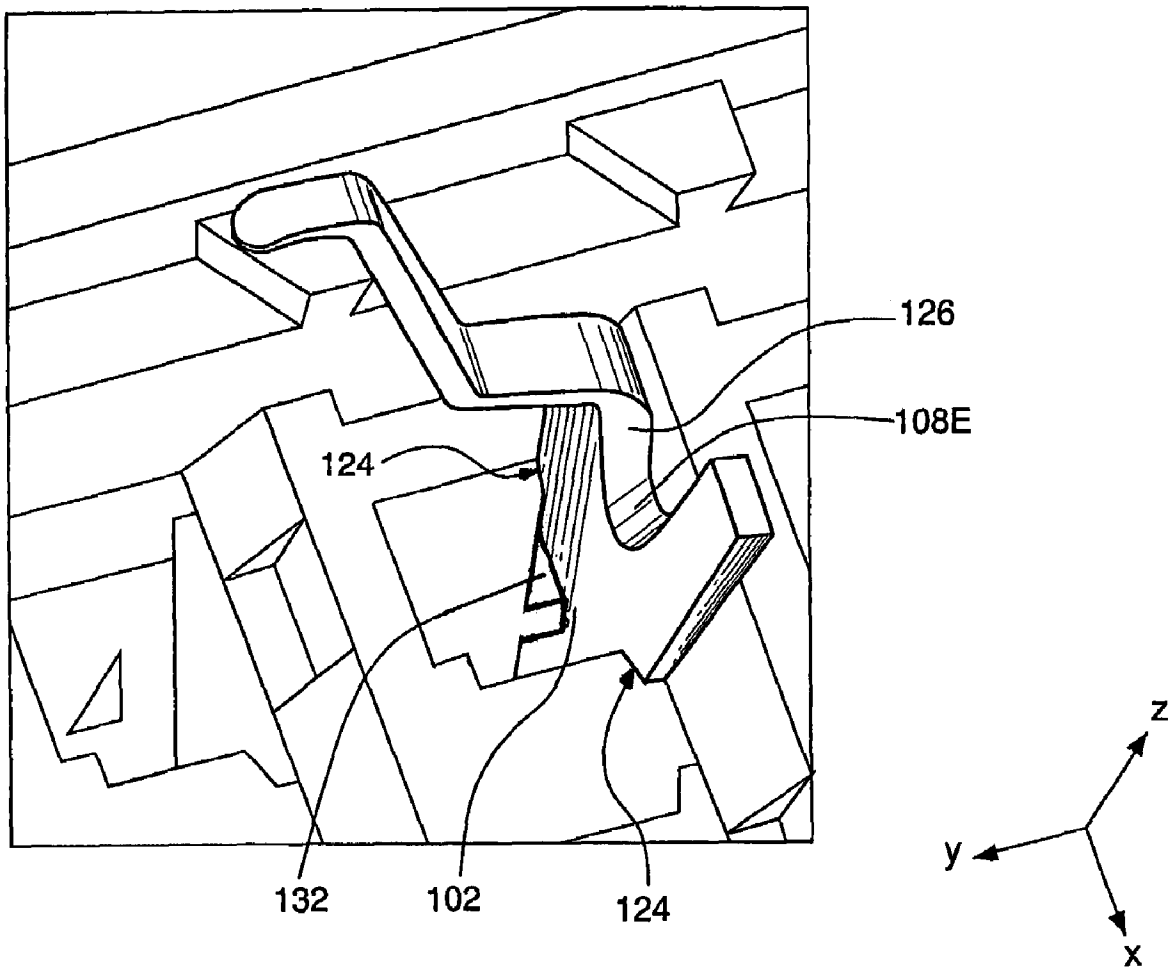
Figure 2D:
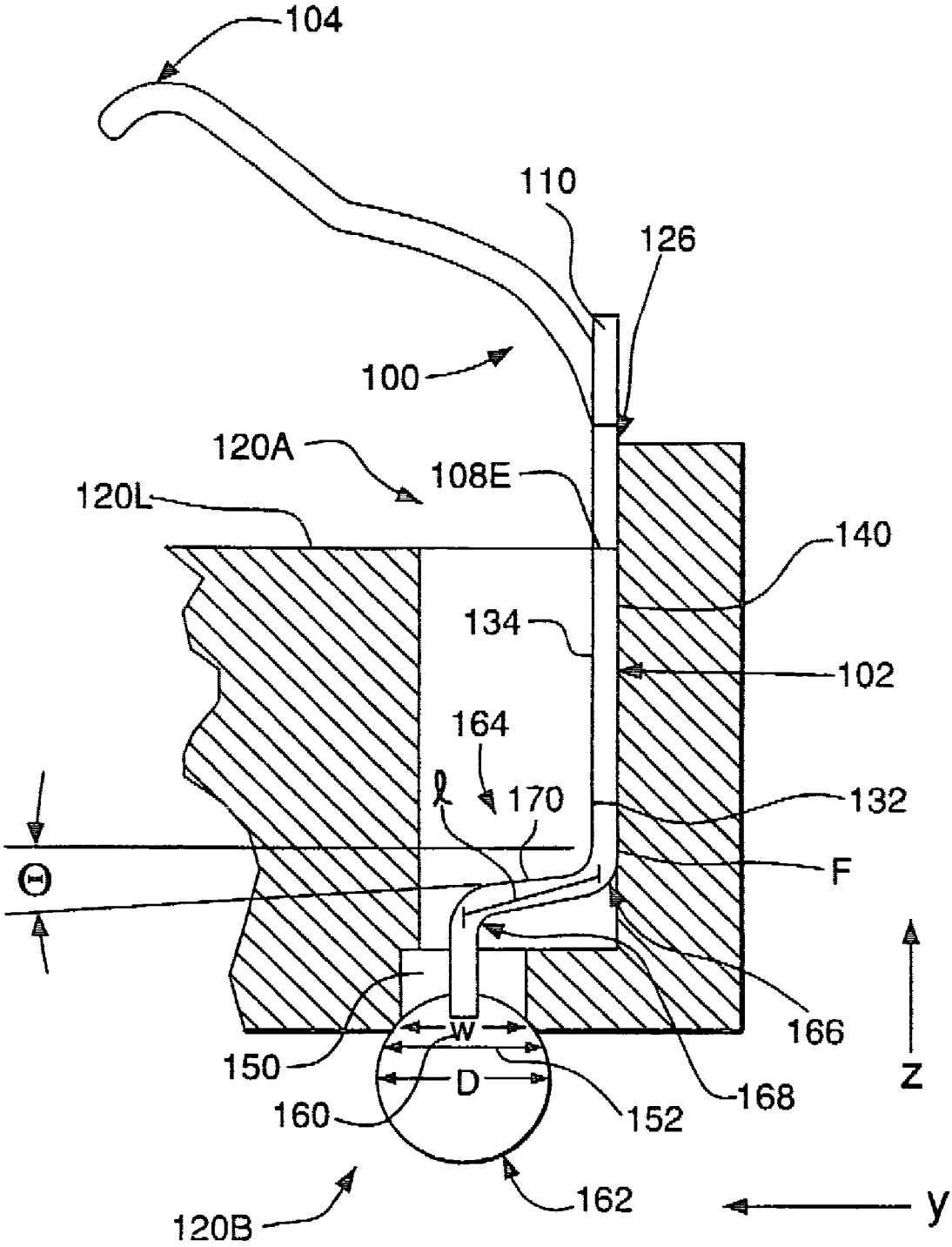

FIGS. 2A–2D depict an example embodiment of a contact receiving well 122 defined by a connector housing 120. FIG. 2A is a top view of a housing 120 having a contact receiving well 122 according to the invention. FIG. 2B is a top view of the contact receiving well 122 with a contact 100 retained therein. FIG. 2C is an isometric view of the contact 100 retained in the housing 120. FIG. 2D is a side view of the contact 100 retained in the housing 120.

As shown, the contact receiving well 122 may be generally "T" shaped, and include a pair of contact retention grooves 124, each of which extends along a back wall 126 of the well 122. The contact retention grooves 124 are configured (i.e., sized and shaped) to receive the body portion 102 of the contact 100 such that the body portion 102 of the contact 100 fits snugly in the contact retention grooves 124. Preferably, each groove 124 extends into the contact receiving well 122 and ends to form a respective lateral surface 132 that is generally perpendicular to the back wall 126 of the well 122. The contact retention grooves 124 may be defined by the back wall 126, a pair of front walls 128, and a pair of side walls 130.

The contact 100 may be aligned with the contact receiving well 122 such that the body portion 102 of the contact 100 aligns with the contact retention grooves 124. The contact 100 may then be press-fit into the housing 120 until the BGA end of the body portion 102 reaches a desired location within the well 122, or until the body portion 102 reaches the lateral surfaces 132. Thus, the lateral surfaces 132 prevent movement of the contact 100 along the receiving direction (that is, along the negative z-axis as shown in FIG. 2D) and can serve as a single datum point from which several dimensional tolerances may be measured.

Preferably, the contact 100 is pressed into the contact receiving well 122 until the end 108E of the alignment slot 108 is generally even with the plane of the LGA interface side 120L of the housing 120. Thus, the LGA contact portion 104 may be cantilevered from the end 108E of the alignment slot 108. It should be understood, however, that the end 108E of the alignment slot 108 may be at, above, or below the LGA interface side 120L of the housing 120.

The contact receiving well 122 may retain and align the contact 100 on both side edges (102C, 102D), and position the back 140 of the body portion 102 against the rear surface 126 of the contact receiving well 122. This tends to reduce or eliminate movement of the contact 100 in the x- and y-directions (as shown in FIG. 2C), as well as rotational movement of the contact 100 around the z-axis. This also tends to center the contact 100 within the well 122.

The use of a contact alignment slot 108 tends to reduce or eliminate twisting and rotation of the contact 100 during insertion of the contact 100 into the housing 120. An insertion tool (not shown) may be used to seat the contact 100 into the housing 120. The tool may be configured with a protrusion having nearly the same size and shape as the contact alignment slot 108. The protrusion may be inserted into the contact alignment slot 108, which, as described above, extends generally into a central portion 102AC of the body portion 102 of the contact 100. When the tool is used to press the contact 100 into the housing 120 (in the negative z-direction), relatively little moment is created around the center of gravity of the contact 100 (in the x-z plane). Thus, use of the alignment slot 108 tends to prevent the contact 100 from rotating in the x-z plane during insertion of the contact 100 into the housing 120.

The contact alignment slot 108 also provides for more control over alignment of the contact in the x-direction. That is, the insertion tool may have a protrusion disposed on a predefined center so that, when the tool is used to press the contact into the housing, the contact is properly aligned on the predefined center. The protrusion, being set into the alignment slot, tends to prevent the contact from moving off center alignment. It should be understood that the tool may include a number of such protrusions that may be set into respective alignment slots of a plurality of contacts. Thus, a plurality of adjacent contacts may be seated properly at predefined locations along the x-direction.

The push shoulder 110 may be used as an alternative to, or in addition to, the contact alignment slot 108 for seating the contact 100 into the connector housing 120. The seating tool may include a complementary shoulder portion that presses onto the push shoulder 110 as the contact 100 is pressed into the housing 120. Further, the push shoulder 110 may extend out of the connector housing 120 (in the z-direction) so that the tool shoulder may be easily pressed down on the push shoulder 110 even after the alignment slot 108 is fully received into the contact receiving well 122.

Figure 3B:
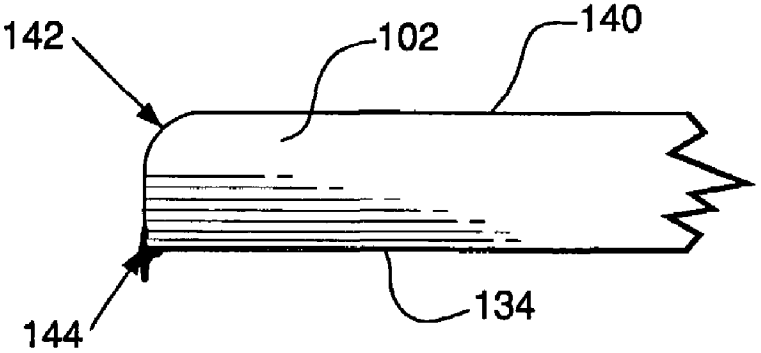
FIGS. 3A and 3B are detailed views of an example embodiment of a contact according to the invention.
Figure 3A:
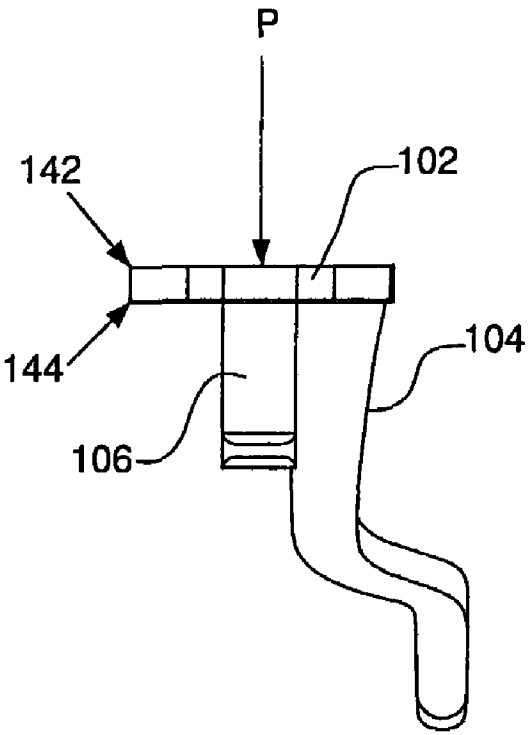

According to an aspect of the invention, the contact may be manufactured such that the "front" side 134 of the body portion 102 "digs" into the "front" walls 128 of the contact receiving well 122. This provides additional stabilization of the contact 100 in the contact receiving well 122. The contact 100 may be die-cut, or "punched," out of a sheet of electrically conductive material, in a punch direction, p, as shown in FIG. 3A. The punch direction p is the direction at which the die presses into the material to form the contact 100. The die rounds the "punch" side edges 142 and creates a sharp, or "burr," edge 144 on the other side 132. When the contact 100 is seated into the connector housing 120, the sharp edges 144, which are best seen in FIG. 3B, dig into the front walls 128 of the housing core 122. The rounded "punch" side 140 helps to ensure that the contact 100 fully seats up against the locating surface, or "back" wall, 126 of the contact receiving well 122.

The sharp edge 144 of the body portion 102 of the contact 100 also provides for stress reduction within the housing 120. Preferably, the housing 120 will be made of a plastic. As the contact 100 is pressed into the well 122, the sharp edge 144 of the body portion 102 gouges the material of which the housing is made. Though the sharp edge 144 may be expected to deform the material somewhat, most of the material will be cut away. Thus, the sharp edge 144 forms a groove in a wall the defines the receiving well 122, where the groove complements the size and shape of the edge 144. To the extent that the material is cut away rather than being deformed, stress buildup throughout the housing may be limited.

With reference once again to FIGS. 2A–2D, and as best seen in FIG. 2D, a ball/contact cavity 150 may be provided to retain the contact 100 in the housing 120 so that the contact 100 can be neither pushed through, nor pulled out of, the housing 120. As described above, the lower surfaces of the body portion 102 keep the contact 100 from being able to be pushed through the housing 120 from the LGA side 120A or pulled out of the housing 120 from the BGA side 120B (i.e., from moving along the negative z-axis as shown in FIG. 2D).

In a preferred embodiment, to prevent movement of the contact 100 along the direction of the positive z-axis, a solder ball 162 may be attached to the contact 100 after the contact 100 is press fit into the housing 120. That is, after the contact 100 is received into the contact receiving well 122, the BGA contact tail 160 sits freely, or "floats," in the ball/contact cavity 150. That is, the BGA contact tail 160 does not necessarily touch any of the side walls of the contact receiving well 122 that define the ball/contact cavity 150. Solder paste (not shown) may be deposited into the cavity 150 via an opening 152. The solder ball 162 may be pressed toward the cavity opening 152 into the solder paste. Finally, the connector assembly (which includes at least the contact 100 in combination with the housing 120) is heated to a temperature that is greater than the liquidous temperature of the solder. This causes the solder to reflow, form a generally spherically shaped solder mass on the contact tail, and metallurgically bond the solder ball 162 to the contact 100.

Preferably, the opening 152 of the cavity 150 has a width w that is less than the diameter d of the solder ball 162 so that the solder ball 162 prevents the contact 100 from being able to be pulled out from the LGA side of the connector housing 120 (i.e., prevents the contact from being pulled along the direction of the z-axis depicted in FIG. 2D). Thus, the contact 100 may be "locked" into the housing 120.

To enable the BGA contact tail 160 to float in the ball/contact cavity 150, the BGA portion 106 of the contact 100 may include a double bend portion 164 between the body portion 102 and the BGA tail 160. Preferably, the double bend portion 164, which is best seen in FIG. 2D, is disposed below the location F at which the contact 100 is rigidly attached to the housing 120. The double bend allows the BGA tail 160 to float vertically (i.e., in the z-direction as shown in FIG. 2D) and laterally (i.e., in the y-direction as shown in FIG. 2D), thus compensating for CTE mismatch and/or housing/PCB bow.

Between the first bend 166 and the second bend 168 is a generally straight beam portion 170. The beam portion 170 is shown at a slightly downward angle θ from the horizontal (i.e., the y-axis shown in FIG. 2D). As shown, θ~4°. The length, l, cross section in the y-z plane, and angle, θ, of the beam portion 170 can control tail compliance and may be adjusted to minimize the load and stress on the solder ball 162. The angle θ may also improve manufacturability by allowing for spring back during stamping of the contact 100 from a sheet of electrically conductive material. Further, depending on environmental and design requirements, the angle θ may not always be required (i.e., θ could be zero), or the beam portion 170 could be angled upward from the horizontal instead of downward (i.e., θ could be positive or negative).

As shown in the following figures, nearly all the load may be carried by the BGA portion 106 of the contact 100. Little to no load may be carried by the ball 162, the body portion 102, or the LGA portion 104 of the contact 100.

Thus there have been described improved housing and contact designs that are suitable for LGA-BGA connectors. It should be understood that the foregoing illustrative embodiments have been provided merely for the purpose of explanation and are in no way to be construed as limiting of the invention. Words that have been used herein are words of description and illustration, rather than words of limitation. Further, though the invention has been described herein with reference to particular structure, materials, and/or embodiments, the invention is not intended to be limited to the particulars disclosed herein. Rather, the invention extends to all functionally equivalent structures, methods, and uses such as are within the scope of the appended claims. Those skilled in the art, having the benefit of the teachings of this specification, may affect numerous modifications thereto and changes may be made without departing from the scope and spirit of the invention in its aspects.

What is claimed:

1. An electrical connector comprising:

a connector housing having a rear wall and three front walls that define a contact receiving well, the contact receiving well extending along a contact receiving direction; and an electrical contact received in the contact receiving well and extending from each of two ends of the contact receiving well, the electrical contact having a body portion in contact with and contained between the rear wall and two of the three front walls, wherein the electrical contact is not in contact with one of the three front walls, wherein the electrical contact includes a ball end, and the contact receiving well includes a cavity through which the contact extends, the cavity being configured to prevent movement of the ball end into the contact receiving well, and wherein a longitudinal axis of the cavity is offset from a longitudinal axis of the contact receiving well.

2. The electrical connector of claim 1, wherein the contact receiving well is further defined by a first side wall that extends between the rear wall and one of the front walls, and by a second side wall that extends between the rear wall and a second of the front walls, wherein the body portion of the electrical contact is in contact with and contained between the first and the second side walls in a direction transverse to the contact receiving direction.

3. The electrical connector of claim 1, wherein the body portion of the contact has a first side, the first side having a sharp edge extending along a length thereof, the contact being disposed within the contact receiving well such that the sharp edge engages at least one of the front wall and the rear wall.

4. The electrical connector of claim 3, wherein the body portion of the contact has a second side opposite the first side, the second side having a rounded edge.

5. The electrical connector of claim 1, wherein the contact receiving well includes an internal surface that extends in a direction transverse to the contact receiving direction and tends to prevent movement of the contact in the contact receiving direction.

6. The electrical connector of claim 5, wherein the contact includes a body portion having an edge that abuts the internal surface when the contact is received into the contact receiving well.

7. The electrical connector of claim 1, wherein the cavity has an opening having a width, and the ball end of the contact has a diameter that is greater than the width of the opening.

8. An electrical connector comprising:

a housing that defines a contact receiving well, the contact receiving well extending along a contact receiving direction; and an electrical contact received in the contact receiving well and extending from each end thereof, the electrical contact including at least two bends angled in relation to the contact receiving direction and located within the contact receiving well, the contact including a ball end attached to a stem of the contact within a cavity configured to prevent movement of the ball end into the contact receiving well.

9. The electrical connector of claim 8, wherein a longitudinal axis of the cavity is offset from a longitudinal axis of the contact receiving well, and the contact includes a tail portion that floats in a cavity of the contact receiving well.

10. The electrical connector of claim 9, wherein electrical connection of the electrical contact to other electrical contacts does not occur within the contact receiving well.

11. An electrical contact, comprising:

a planar body portion having a first end and a second end opposite the first end, the first and the second ends tending to define a length of the electrical contact;

a first contact portion having a single stem extending from the first end of the body portion and tending to increase the length of the electrical contact; and a second contact portion having a single stem extending from the second end of the body portion and tending to further increase the length of the electrical contact;

wherein the second contact portion is a BGA tail portion including two bends located within a contact receiving well and angled in relation to a lengthwise direction of the electrical contact; and wherein the body portion includes a slot within the first end of the body portion adjacent to the first contact portion.

12. The electrical contact of claim 11, further comprising:

a push shoulder extending from the body portion, the push shoulder having a push surface for seating the contact into a connector housing.

13. The electrical contact of claim 11, wherein a longitudinal center line of the slot is aligned with a longitudinal center line of the body portion of the contact.

14. The electrical contact of claim 11, wherein a longitudinal center line of the BGA tail portion is not aligned with a longitudinal center line of the body portion of the contact.

15. The electrical contact of claim 11, wherein the first contact portion is an LGA contact portion.

16. The electrical contact of claim 15, wherein the first contact portion includes three bends in relation to a lengthwise direction of the electrical contact.

17. An electrical connector comprising:

a connector housing having a contact receiving well; and an electrical contact received in the contact receiving well, the contact having a planar body portion residing within the contact receiving well, a single stem LGA portion extending from the body portion and from the contact receiving well, and a single stem BGA portion having a double bend terminating at a ball end, wherein the double bend terminates in a cavity in the contact receiving well, the cavity has an opening the opening has a width, and the ball has a diameter that is greater than the width of the opening.

18. The electrical connector of claim 17, wherein the double bend portion enables the BGA tail to float in the cavity in the contact receiving well, wherein a longitudinal center line of the cavity is not aligned with a longitudinal center line of the contact receiving well.

19. An electrical connector comprising:

a connector housing that defines a contact reception cavity, a first wall that protrudes into the contact reception cavity, and a second wall that also protrudes into the contact reception cavity, wherein the first wall and the second wall each partially separate the contact reception cavity into a first cavity portion and a second cavity portion; and an electrical contact that defines a retention portion, a mating contact end attached to the retention portion of the electrical contact, and a mounting contact end attached to the retention portion of the electrical contact, the mounting contact end having a single stem with two bends within the contact reception cavity;

wherein the retention portion of the electrical contact is retained in the first cavity portion defined by the connector housing and the first and second walls and does not extend into the second cavity portion defined by the connector housing and the first and second walls.

* * * * *